United States Patent [19]

Odien

[11] Patent Number: 5,001,853

[45] Date of Patent: Mar. 26, 1991

[54] ORNAMENT FOR GIFT PACKAGE

[76] Inventor: Larry R. Odien, 28370 N. Evergreen La., Saugus, Calif. 91350

[21] Appl. No.: 331,814

[22] Filed: Apr. 3, 1989

[51] Int. Cl.[5] ..... G09F 3/00

[52] U.S. Cl. ..... 40/312; 40/124.1; 40/160; 206/575; 206/475

[58] Field of Search ..... 40/312, 124.4, 124.2, 40/124, 124.1, 160; 206/223, 575, 475

[56] References Cited

U.S. PATENT DOCUMENTS

| | | | |
|---|---|---|---|
| 1,473,800 | 11/1923 | Webb | 40/124.1 |
| 2,188,750 | 1/1940 | Hacker | 40/312 |
| 2,651,131 | 9/1953 | Long et al. | 40/124.1 |
| 2,655,260 | 10/1953 | Clerc | 40/312 |
| 2,736,115 | 2/1956 | James | 40/312 |
| 2,976,632 | 3/1961 | Phillips | 40/124 |
| 3,026,639 | 3/1962 | Lille | 40/124.1 |
| 3,321,860 | 5/1967 | Dichtl et al. | 40/160 |
| 4,014,121 | 3/1977 | Moser | 40/124.1 |
| 4,101,032 | 7/1978 | Obidniak | 206/457 |
| 4,102,456 | 7/1978 | Morris | 206/575 |
| 4,841,651 | 6/1989 | Conner | 40/160 |

FOREIGN PATENT DOCUMENTS

| | | | |
|---|---|---|---|
| 0077426 | 4/1983 | European Pat. Off. | 206/275 |

*Primary Examiner*—Kenneth J. Dorner
*Assistant Examiner*—Brian K. Green
*Attorney, Agent, or Firm*—Gene W. Arant

[57] ABSTRACT

An ornament for attachment to the outside of a gift package that has at least one substantially flat surface includes a single sheet member formed with a substantially flat back portion which is adapted to fit against the surface of the gift package, and a plurality of spaced separate areas which are bulged outwardly away from the back portion to provide corresponding frontal protrusions. The frontal protrusions have differing shapes and appearances, and may also have colors added to their front surfaces so as to present artistic objects having a realistic appearance. In a preferred form of the invention the ornamental features portrayed by the front surfaces of the protrusions include at least one hand having a slit that is parallel to the back portion of the sheet member, and which is adapted to hold a gift card.

9 Claims, 2 Drawing Sheets

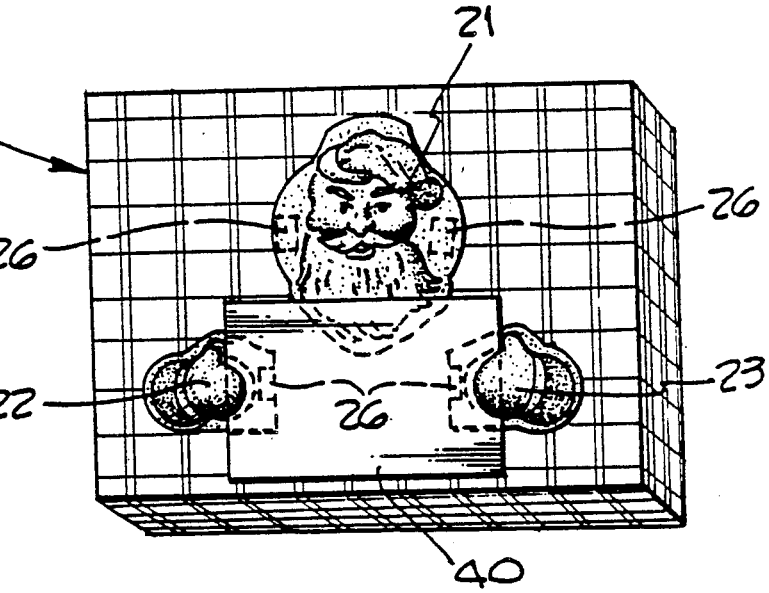
Fig. 7.
Fig. 5.
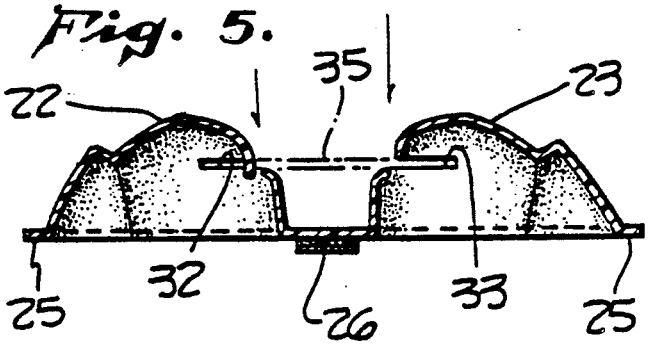
Fig. 8.
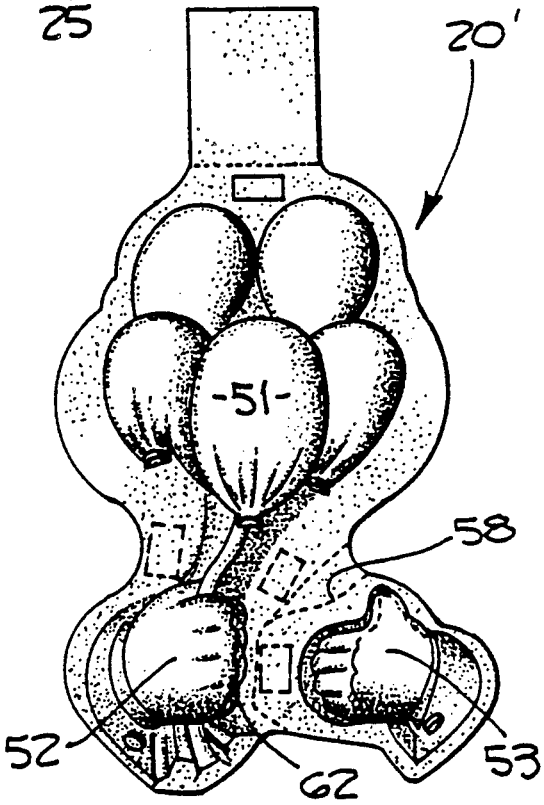
Fig. 6.
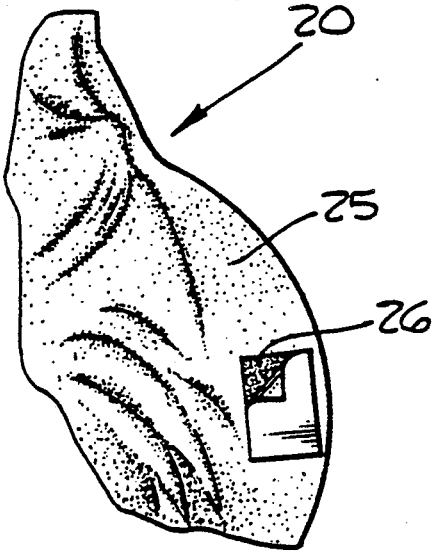

ORNAMENT FOR GIFT PACKAGE

BACKGROUND OF THE INVENTION

It has heretofore been well known to provide a commercial kit for use in wrapping a gift, which includes a gift card for placement inside the gift package, a quantity of colorful wrapping paper for wrapping the outside of the package, and an ornamental ribbon for attachment to the outside of the package.

Such kits are commonly sold with the paper being folded to about an 8½ by 11 inch size, and with the paper and gift card being placed inside a transparent plastic envelope. Then a folded cardboard header is placed over the otherwise open end of the envelope to close it, the sides of the header are secured to each other and/or to the envelope in order to keep it closed, and the ribbon is then attached on an outer surface of the header.

SUMMARY OF THE PRESENT INVENTION

According to the present invention a novel but inexpensive plastic ornament is provided, which may be used in a gift wrap kit in lieu of the ribbons heretofore employed.

The plastic ornament according to the present invention is formed from a single sheet member of plastic material by a vacuum forming process, and provides a plurality of different ornamental features.

More specifically, the plastic sheet has a flat back portion which is adapted to fit against the transparent plastic envelope, and has a plurality of areas which are separately bulged outwardly away from the back portion so as to provide frontal protrusions which have differing artistic shapes and appearances.

According to one embodiment of the invention the frontal protrusions include a face and a pair of hands, and colors are added to the front surface of the material on both the face and the hands so as to present a realistic artistic appearance. The face and hands may, for example, portray a Santa Claus, a human being, or a pet or other animal.

According to a specific feature of the invention each of the protrusions forming one of the hands has a narrow slit on the side thereof which faces the protrusion forming the other hand, the two slits occupying a common plane substantially parallel to the flat back portion of the plastic sheet, such that when the ornament is affixed to the outside of a gift package, a gift card may then be lodged within the two slits as if it were being held in the two hands.

According to another embodiment of the invention a similar arrangement of flat back portion and frontal protrusions is employed, but the protrusions portray inanimate structures.

According to one particular feature of the invention the plastic sheet is formed with a small fastening tab protruding at its upper end, and the fastening tab is then placed inside the cardboard header of the gift wrap kit before the header is secured to the envelope.

According to still another specific feature of the invention the plastic sheet is formed with perforation lines separating the various ornamental features. Thus, if a large package is being wrapped, the plastic sheet may be cut along the perforation lines and the separate ornamental features may be attached to the package in more widely separated locations than they originally had before the plastic sheet was cut.

According to another feature of the invention the ornament is provided with a plurality of adhesive tabs on the back or under surface of its flat back portion, so that it can be conveniently attached to the front side of the gift package.

According to a further specific feature of the invention at least one protrusion forming a hand has a narrow slit which is cut through the top of the protrusion from a direction perpendicular to the back side of the sheet member, but the plastic material can be deformed so that the slit then appears on the side of the protrusion and occupies a plane substantially parallel to the back portion of the plastic sheet member.

DRAWING SUMMARY

FIG. 5 is a cross-sectional plan view taken on the line 5—5 of FIG. 3;

FIG. 6 is a fragmentary rear elevation view of the Santa Claus figure, taken on line 6—6 of FIG. 4;

FIG. 7 is a face view, partly in perspective, showing the Santa Claus figure of FIG. 1 when it has been attached to the front of a larger gift package, and the various individual portions of the ornament have been separated accordingly; and FIG. 8 is a face view of an alternate form of ornament in accordance with the invention.

DETAILED DESCRIPTION

Reference is now made to the drawings and particularly to FIGS. 1 through 6 which illustrate one preferred form of the invention.

Figure 1:
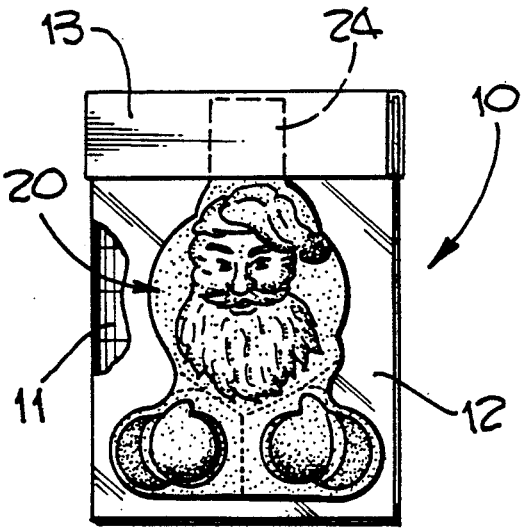
FIG. 1 is a face view of a gift wrap kit which, in accordance with the present invention, includes a novel ornament that depicts a Santa Claus figure.
Figure 2:
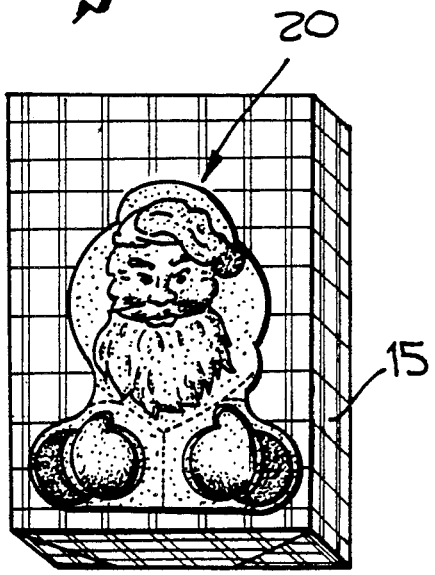
FIG. 2 is a face view, partly in perspective, showing the Santa Claus figure of FIG. 1 when it has been attached to the front of a gift package.

A commercial kit 10 as shown in FIG. 1 is intended for use in wrapping a gift. It includes a gift card, not shown, for placement either inside or outside the gift package; a quantity of colorful wrapping paper 11 for wrapping the outside of the package; an ornament 20 for attachment to the outside of the package; a transparent flat plastic envelope 12 enclosing the paper and gift card; and closure means 13 securing the otherwise open end of the envelope to close it.

A plastic ornament 20 is formed by a vacuum forming process from a single sheet member of plastic material. The main portion of the sheet member 20 forms a flat back portion which is adapted to fit against a flat surface, and has a plurality of spaced separate areas which are bulged outwardly away from the flat back portion to provide corresponding frontal protrusions including a face protrusion 21 and hand protrusions 22, 23. In the particular embodiment the frontal protrusions have differing shapes and appearances to provide a face 21 and hands 22, 23 which portray a Santa Claus, the front surfaces of those protrusions being colored in an appropriate manner so as to present a realistic artistic appearance.

The colors are preferably added by means of photolithograph printing of the upper flat surface of the plastic member, before it is formed in the vacuum process.

The ornament 20 also includes a small fastening tab 24 which protrudes from the upper end of the sheet. When the ornament is part of the kit 10 as shown in FIG. 1, the tab 24 is utilized for attachment to a cardboard header 13 that provides the means for securing the upper end of envelope 12 in a closed condition.

The under surface of the flat portions of the sheet 20 is designated by the numeral 25. Adhesive tabs 26 are attached to under surface 25 at various locations intermediate to the frontal protrusions, and provide means for attaching the under surface of the flat back portion of the ornament to the front face of a gift package.

An additional feature of the embodiment of FIGS. 1 through 6 is that each of the protrusions forming one of the hands has a narrow slit on the side thereof which faces the protrusion forming the other hand, the two slits occupying a common plane substantially parallel to the flat back portion of the plastic sheet. The slits in the hands 22, 23, are designated 32, 33, respectively. When the ornament is affixed to the outside of a gift package such as the package 15 shown in FIG. 2, a gift card 35 may then be lodged within the two slits as if it were being held in the hands.

Figure 3:
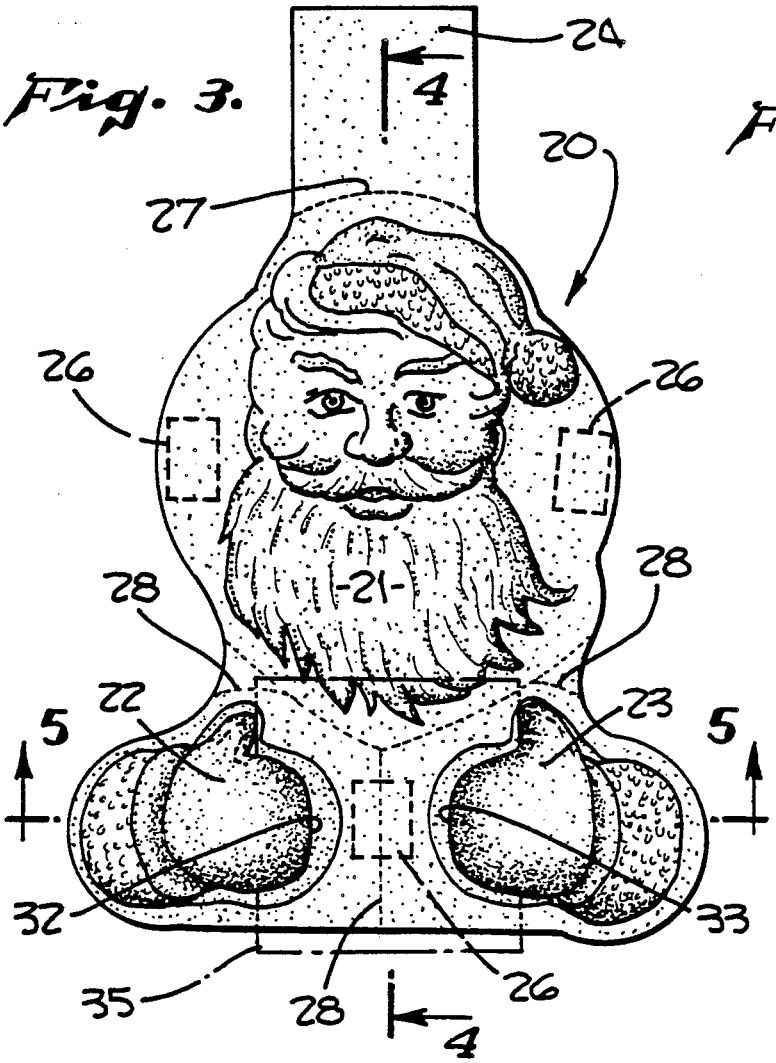
FIG. 3 is an enlarged face view of the Santa Claus figure of FIGS. 1 and 2, showing a gift card grasped between the two hands.
Figure 4:
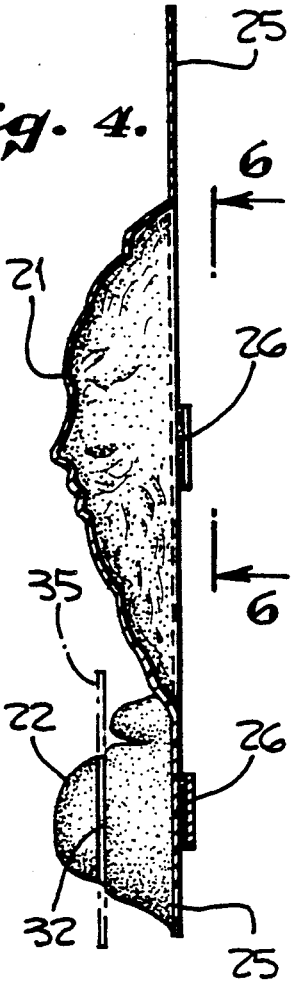
FIG. 4 is a vertical cross-sectional view taken on the line 4—4 of FIG. 3.

As specifically shown in FIG. 5, the protrusion forming each hand has a narrow slit which is cut through the top of the protrusion from a direction perpendicular to the back side of the sheet member, but the plastic material is subsequently deformed so that the slit then appears on the side of the protrusion and occupies a plane substantially parallel to the back portion of the plastic sheet member. By slightly deforming the thin plastic sheet member, a slit which was formed perpendicularly becomes parallel during use. This result is facilitated by the fact that the slit such as slit 32 shown in FIG. 3 is not a straight line when seen in plan view, but instead has a somewhat curved or arcuate configuration.

The plastic sheet 20 is also formed with perforation lines separating different frontal protrusions thereof, such that if a large package is being wrapped the plastic sheet may be cut along said perforation lines and the separate ornamental features may then be attached to the package in more widely separated locations than they had originally occupied before the plastic sheet was cut. Thus, performation line 27 separates the tab 24 from the remainder of sheet 20, and a set of perforation lines 28 separate the hands 22, 23 from each other and also from the remainder of the sheet 20.

Thus as shown in FIG. 7 a larger card 40 may be used, either with or without a larger package such as the package 17. When a larger package is being wrapped, the plastic sheet may be cut along the perforation lines 27, 28, and the separate ornamental features may be attached to the package in more widely separated locations than they originally had before the plastic sheet was cut.

Although adhesive tabs are illustrated as the means for securing the ornament to the face of the package, it will be understood that, if desired, small pieces of transparent adhesive tape (commonly known as scotch tape) may be used at the edges of the ornament to fasten it down.

ALTERNATE FORM

FIG. 8 shows only one of many possible alternate forms of the invention. As shown in FIG. 8, the ornament 20′ has frontal protrusions appearing as an inanimate object 51 with two hands 52, 53. Only the hand 52 is provided with a slit 62 that is parallel to the back face of the ornament. Perforation lines 58 make it possible to separate the hand 53 from the remainder of the ornament, leaving the hand 52 and its slit 62 to alone support a gift card.

While the ornament of the present invention has been shown as having a flat back surface adapted to fit on a flat package, it will be understood that the surface of the package may not necessarily be absolutely flat, but only substantially so. Also, the back surface of the ornament need not be absolutely flat, but in any event can be deformed somewhat to fit against a slightly curved surface.

While it is presently preferred to form the ornament of the present invention from a single plastic sheet member, the ornament may if desired be formed from pressed cardboard, paper mulch, or the like.

The present invention has been disclosed in considerable detail in at least one of its forms in order to comply with the patent laws, but it will be understood that many variations are possible within the scope of the concepts illustrated or described herein, and that the scope of the invention is to be limited only in accordance with the appended claims.

What is claimed is:

1. In a commercial kit for use in wrapping a gift, which includes a gift card for placement inside a gift package, a quantity of colorful wrapping paper for wrapping an outside of the package, an ornament for attachment to the outside of the package, a transparent flat plastic envelope enclosing the paper and gift card, and closure means securing an otherwise open end of the envelope to close it, the improvement comprising:

a plastic ornament formed by a vacuum forming process from a single sheet of plastic material, having a flat back portion adapted to fit against a flat surface of the transparent plastic envelope, having an upper end from which there protrudes a small fastening tab that is adapted for attachment to the closure means, and a plurality of spaced separate areas which are bulged outwardly away from said flat back portion to provide corresponding frontal protrusions;

said frontal protrusions having differing shapes and appearances, and having front surfaces to which colors are added so as to present a realistic artistic appearance; and means for attaching an under surface or said flat back portion or said ornament to a front face of a gift package.

2. The gift wrapping kit according to claim 1 wherein said plastic sheet is formed with perforation lines separating different frontal protrusions thereof, such that if a large package is being wrapped the plastic sheet may be cut along said perforation lines and separate ornamental features may then be attached to the package in more widely separated locations than they had originally occupied before the plastic sheet was cut.

3. The gift wrapping kit according to claim 1 wherein said frontal protrusions portray ornamental features including a face and a pair of hands.

4. The gift wrapping kit according to claim 1 wherein said frontal protrusions portray ornamental features including at least one inanimate object.

5. An ornament for attachment to an outside of a gift package that has at least one flat surface, said ornament comprising:

a single sheet of plastic material formed by a vacuum forming process, having a flat back portion adapted to fit against the flat surface of the gift package, and a plurality of spaced separate areas which are bulged outwardly away from said flat back portion to provide corresponding frontal protrusions;

said frontal protrusions having differing shapes and appearances, and having front surfaces to which colors are added so as to present ornamental features having a realistic artistic appearance;

wherein said ornamental features portrayed by the front surfaces of said protrusions include a face and a pair of hands; and each of said protrusions forming one of said hands having a side with a narrow slit therein which faces the protrusion forming the other hand, said plastic sheet being continuous except for said slits, and said two slits occupying a common plane that lies substantially parallel to said flat back portion of said plastic sheet such that when said ornament is affixed to the outside of a gift package a gift card may then be lodged within said two slits as if it were being held in said hands.

6. An ornament for attachment to an outside of a gift package having at least one flat surface, said ornament comprising:

a sheet member formed to have a flat back portion adapted to fit against the flat surface of the gift package, and a plurality of spaced separate areas which are bulged outwardly away from said flat back portion to provide corresponding frontal protrusions, each of said frontal protrusions lying wholly within a perimeter of said sheet member;

a plurality of adhesive tabs secured in spaced locations to an under surface of said flat back portion intermediate to said protrusions, for purpose of securement to the gift package;

said frontal protrusions having differing shapes and appearances, and having front surfaces to which colors are added so as to present a realistic artistic appearance;

said ornamental features portrayed by the front surfaces of said protrusions including at least one hand;

said protrusion forming said one hand having a narrow slit on one side thereof, said slit being in a curved portion of said protrusion and in a plane that lies substantially parallel to said flat back portion od said sheet member such that when said ornament is affixed to the outside of a gift package a gift card may then be lodged within said slit as if it were being held in said one hand.

7. An ornament for attachment to a substantially flat outer surface of a gift package, said ornament comprising:

a single sheet member of plastic material having a substantially flat back portion adapted to fit against the surface of the gift package;

said plastic sheet member being formed by a vacuum forming process and having a plurality of spaced separate areas which bulge outwardly away from said flat back portion to provide corresponding frontal protrusions, each of said frontal protrusions lying wholly within a perimeter of said plastic sheet member;

said front protrusions having differing shapes and appearances so as to represent different artistic objects;

means for securing said sheet member to the surface of the package;

at least one of said protrusions having a narrow slit which is cut in a direction perpendicular to a back side of the sheet member, said protrusion having a somewhat curved or arcuate configuration in a plane substantially parallel to the back portion of the plastic sheet member;

and wherein the plastic material may then be deformed so that the slit may be used to support a greeting card in a position essentially parallel to the gift package surface.

8. An ornament for attachment to a substantially flat outer surface, said ornament comprising:

a single sheet member of plastic material having a substantially flat back portion adapted to fit against the flat surface;

said plastic sheet member being formed by a vacuum forming process and having a plurality of spaced separate areas which bulge outwardly away from said flat back portion to provide corresponding frontal protrusions, each of said frontal protrusions lying wholly within a perimeter of said plastic sheet member;

said front protrusions having differing shapes and appearances so as to represent different artistic objects;

two of said protrusions having mutually facing sides and each of said two protrusions having a narrow slit which is cut from a direction perpendicular to said flat back portion of the sheet member; and a flat card member disposed substantially parallel to said flat back portion of the plastic sheet member and extending within both of said slits to be supported thereby;

the plastic material being then deformed so that said slits occupy a common plane substantially parallel to said flat back portion of the plastic sheet member.

9. The ornament of claim 8 wherein said slits are cut in a somewhat curved or arcuate configuration in said common plane.

* * * * *